United States Patent [19]

Cox

[11] 3,967,328

[45] July 6, 1976

[54] LOAD LIFTING AND TRANSFERRING DEVICE WITH MULTIPLE POWERED BELTS

[76] Inventor: Ellis V. Cox, 18601 S. Pear Road, Oregon City, Oreg. 97045

[22] Filed: Sept. 6, 1974

[21] Appl. No.: 503,710

[52] U.S. Cl. ..... 5/81 R; 5/84
[51] Int. Cl.[2] ..... A47B 83/04; A61G 1/02
[58] Field of Search ..... 5/81 R, 81 B, 84

[56] References Cited

UNITED STATES PATENTS

| | | | |
|---|---|---|---|
| 2,630,583 | 3/1953 | Gilleland | 5/81 B |
| 3,493,979 | 2/1970 | Koll et al. | 5/81 B |
| 3,654,644 | 4/1972 | Stevens | 5/81 R |
| 3,810,263 | 5/1974 | Taylor et al. | 5/81 R |
| 3,854,152 | 12/1974 | Chez | 5/81 R |

*Primary Examiner*—Robert L. Wolfe
*Assistant Examiner*—Andrew M. Calvert
*Attorney, Agent, or Firm*—James D. Givnan, Jr.

[57] ABSTRACT

A device for loading and transporting patients or other objects from an irregular supporting surface. The device includes a main cabinet on which is supported a carriage including a belt for extension into lifting engagement with the article to be lifted. Adjacent each side of the cabinet are adjustable panels each of which also includes a carriage and carriage belt for engagement with the article lifted jointly with the belt on the cabinet. Powered arms within the cabinet position the joined carriages uniformly toward and away from engagement with the lifted article. The cabinet carriage and the panel carriages are pivotally connected to permit positioning of the panel carriages in an inclined manner to locate same according to the inclination of the load to be lifted. For powering the carriage and panel belts a system of cable reels is provided with certain of said reels mounted on the carriages and displaceable therewith during load pick up and retrieval. Mounted on said cabinet is a cable control reel which may be locked during forward extension of the carriages thereby imparting rotation to the forwardly advancing belts while conversely upon unlocking of the cable control the load supporting belt will remain immobile during retraction of the carriage with the loaded article in place on said belt.

12 Claims, 9 Drawing Figures

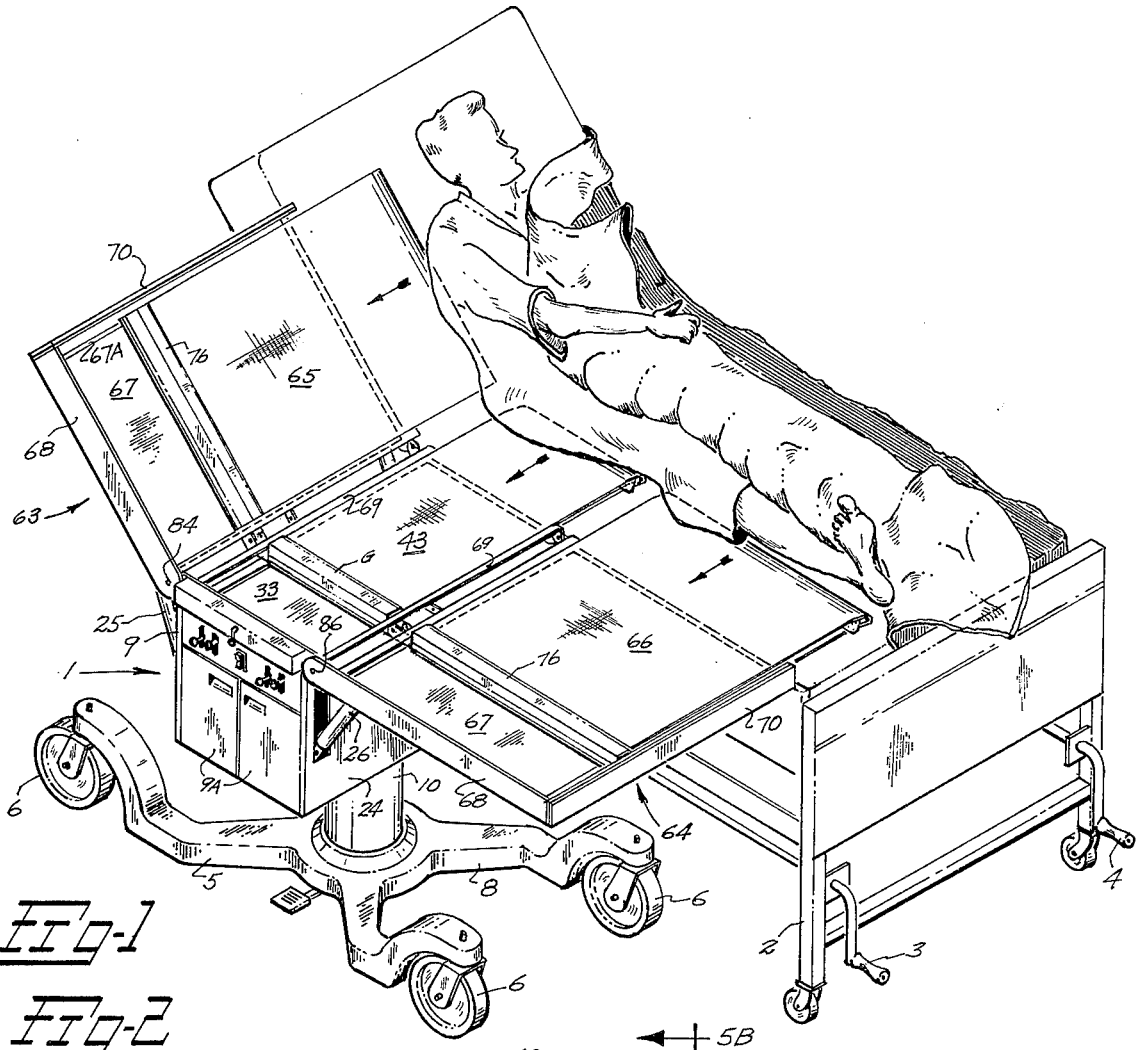
FIG-1
FIG-2
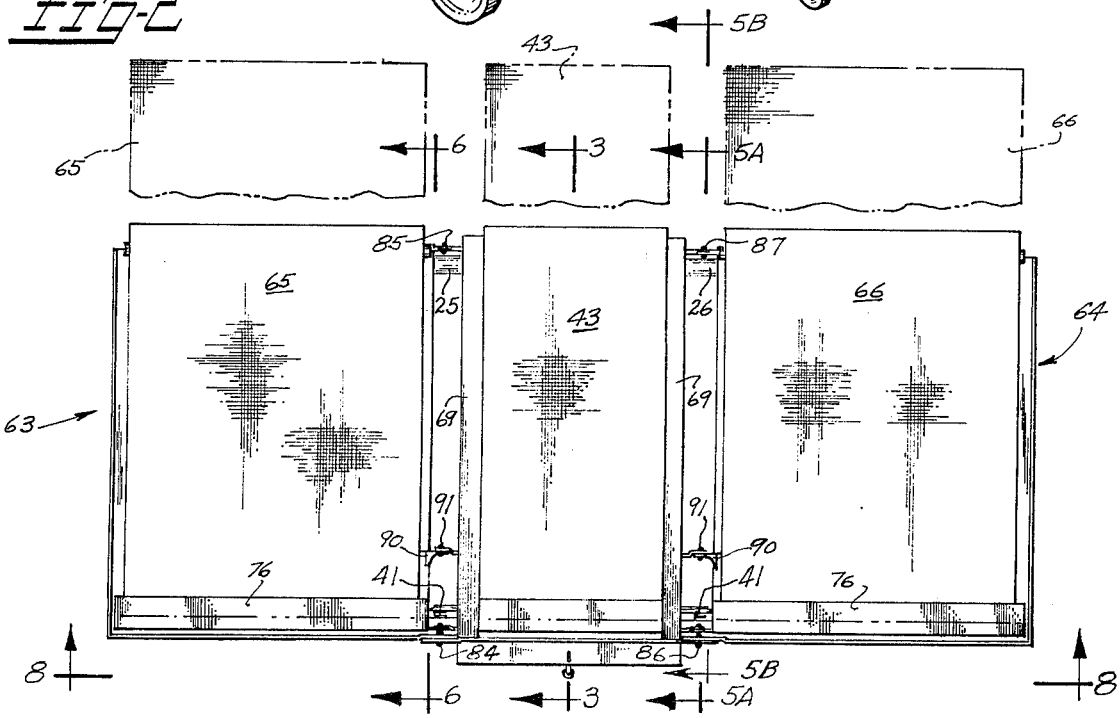

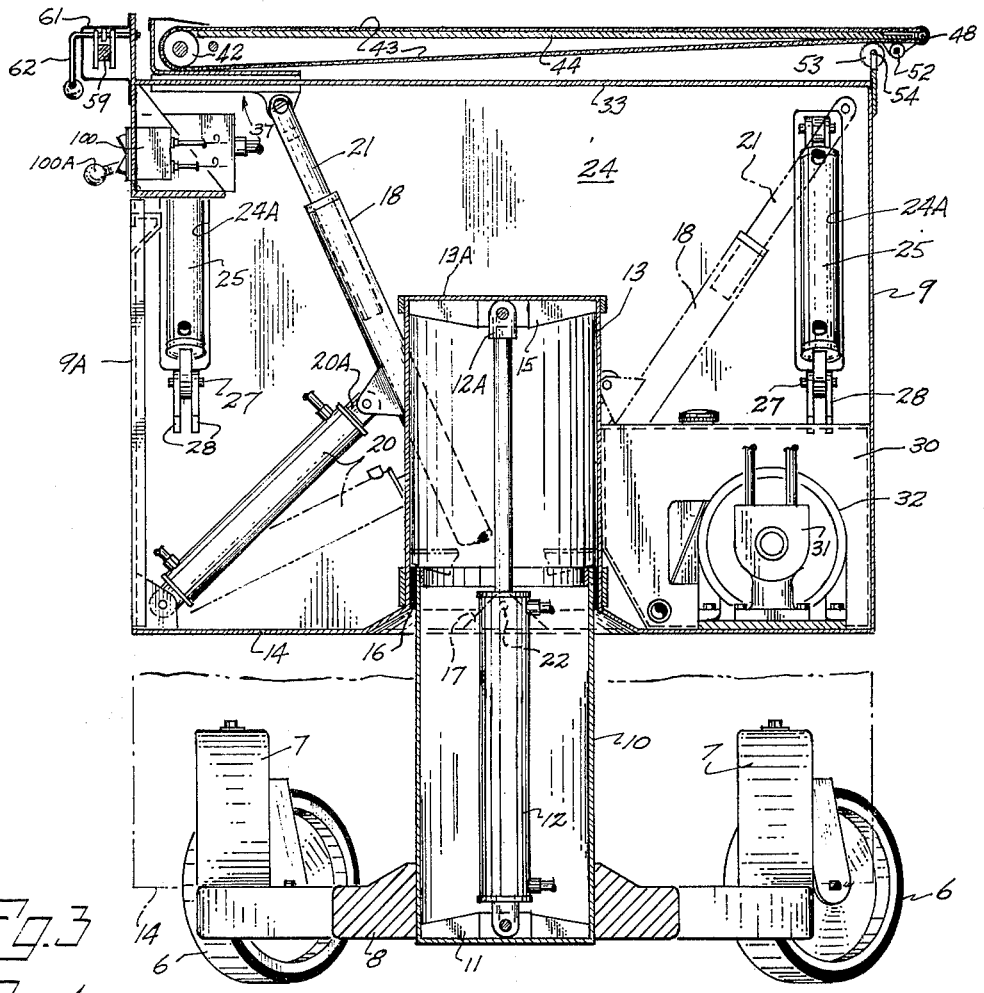
Fig. 3
Fig. 4
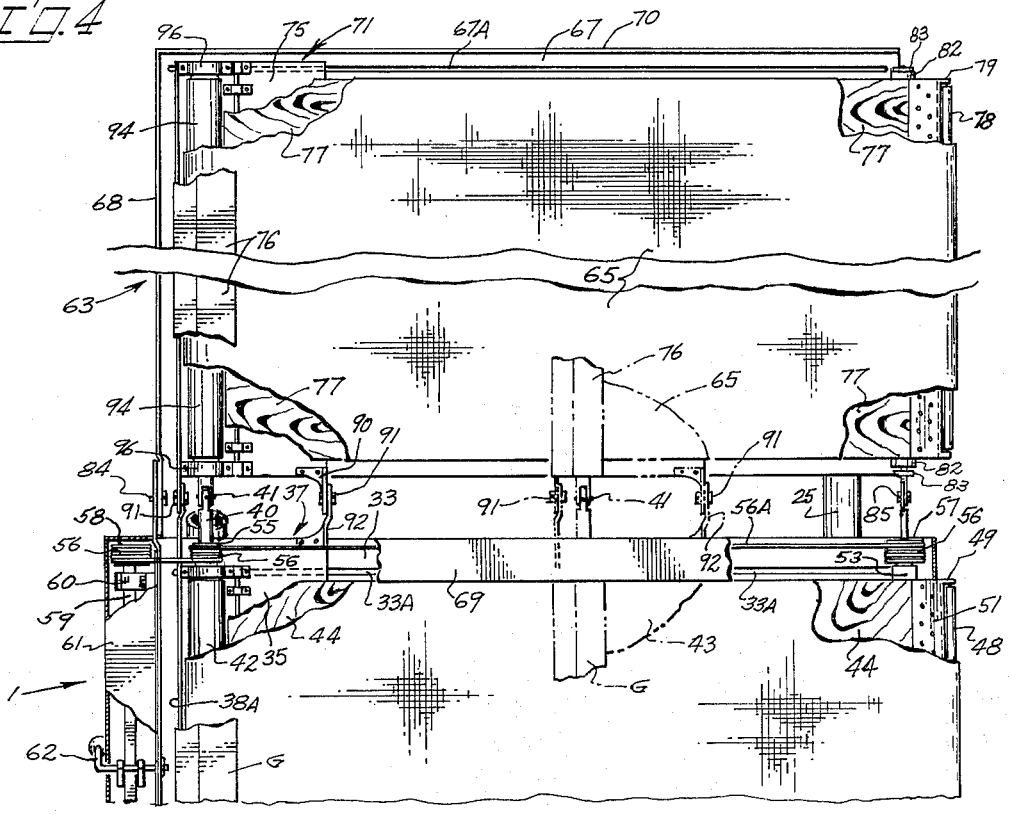

LOAD LIFTING AND TRANSFERRING DEVICE WITH MULTIPLE POWERED BELTS

BACKGROUND OF THE INVENTION

The present invention relates generally to load lifting and transporting devices and more specifically to one shown and described for use in the loading and transportation of invalids from a hospital bed.

The prior art includes various types of apparatuses directed toward overcoming the arduous task of manually lifting and transferring invalids from one supporting surface, such as a bed, to a mobile support. U.S. Pat. Nos. 3,493,979; 2,587,068; 3,593,351; 3,667,073; 2,733,452 all disclose means primarily for such transfer operations. A discussion of the problems encountered in manual transferring of invalids is set forth in the above first mentioned patent. U.S. Pat. No. 3,493,979 is of particular interest in that it shows one concept for powering a movable belt assembly for patient pick up.

A disadvantage common to a number of the prior art embodiments is their inability to transfer a patient while in other than a supine position. In some instances, it is undesirable for medical reasons to reposition the patient into the supine position. A further disadvantage found in the known invalid transfer devices is their high cost of manufacture resulting in restricted availability to small hospitals, nursing homes, etc. Related to their costly, complex nature is the reliability factor. Obviously, it is highly desirable to embody the transfer device in the simplest form possible to allay servicing problems and malfunctions during patient transfer.

Not found in the prior art are devices capable of being stowed within a relatively small area. In most hospitals, nursing homes, etc., storage space is very limited making a non-collapsible transfer device objectionable. Further, bulky, non-collapsible equipment hinders personnel by restricting their mobility.

SUMMARY OF THE INVENTION

The present invention is embodied, in one form, in a patient handling device capable of lifting and transferring same from either a lying or partially sitting bed position. Such a use is not intended to imply any functional limitations of the device.

The present embodiment includes a wheel supported base which directly supports a vertically positionable equipment cabinet which houses the fluid powered components and a power source for same. Swingably mounted to each side of the cabinet are panels independently positionable to receive the upper or lower portion of the patient's body. Said panels and the upper portion of the equipment cabinet serve to carry patient lifting and transfer belts mounted on extensible carriages which are extensible toward the reclining patient. Said carriages and powered belts thereon are operable throughout a wide range of panel positions to adapt same for patient transfer while the patient remains in an optimum position. A main carriage, associated with the cabinet, is shifted transversely of the cabinet by a pair of hydraulic cylinders acting through telescopic arms. Rotation is imparted to the patient lifting belts on the cabinet and panels by means of a drum and cable system on the cabinet. Universal drive connections between the drum and cable system on the cabinet and belt carrying rolls on the panels permit simultaneous driving of the panel belts for joint operation with the cabinet associated belt during patient lifting and transfer.

The belt control system includes a pair of lockable cable control drums, having a fixed axis, which are lockable against rotation by an operator controlled lock. Cables carried by said drums are entrained about stationary reels and shiftable reels. Displacement of the latter with the cable "locked" results in rotation of the cable reels to drive the patient engaging belts during patient pick up. Unlocking of the cable control drums permits retrieval of the belts and carriages (with the patient thereon) without belt rotation.

From the foregoing it will be apparent that the present device has among its important objectives the provision; of a patient transferring device capable of making patient transfer from a bed to the mobile device without requiring the patient to alter his bed position; of a transferring device having independently tiltable belts simultaneously engaging at their leading edges the patient's body to exert a gently lifting action on the legs, the torso and the head with subsequent transverse relocation of the patient on the device for travel; of a device collapsible into compact configuration for storage; of a device having few powered components each of high reliability and of a durable nature to provide trouble free operation; of a device having roller supported extensible means facilitating patient transfer regardless of patient exerted loads encountered. These and other objectives will become readily apparent from an understanding of the following description.

BRIEF DESCRIPTION OF THE DRAWINGS

In the accompanying drawings:

FIG. 1 is a perspective view of the present device initiating lifting of a patient from a hospital bed, FIG. 2 is a plan view of the present device with the side panels positioned to the horizontal, FIG. 3 is a vertical section of a cabinet of the device taken along line 3—3 of FIG. 2, FIG. 4 is an enlarged, fragmentary plan view of the cabinet and a horizontally disposed panel, FIG. 6 is an elevational view of a panel taken along line 6—6 of FIG. 2 with the panel carriage retracted.

DETAILED DESCRIPTION OF THE PREFERRED EMBODIMENT

Figures 5, 5A, 5B:
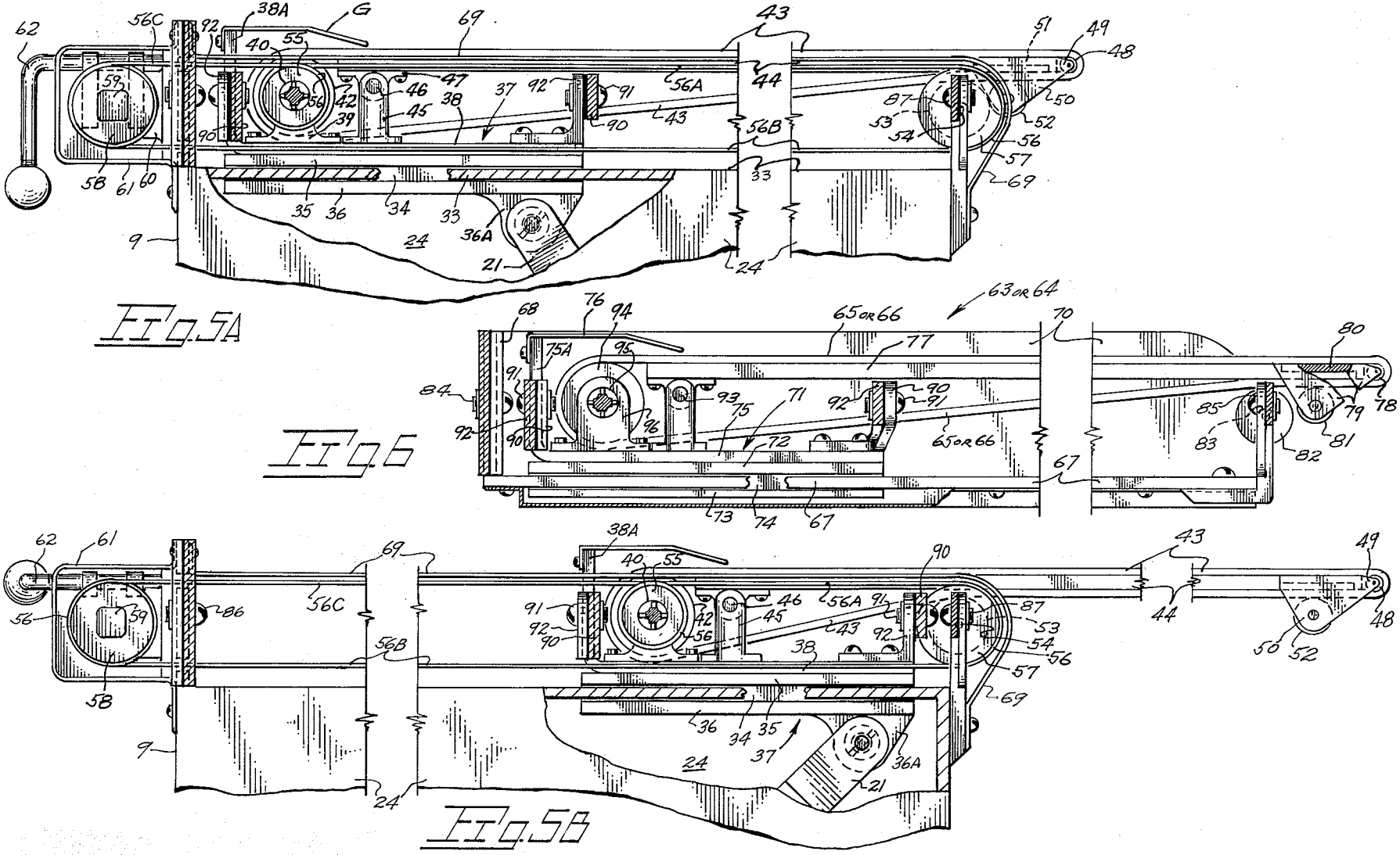
FIG. 5A is an elevational view of the upper end of the cabinet taken along line 5A—5A of FIG. 2 with a retracted carriage in place thereon.
FIG. 5B is a view similar to FIG. 5A and taken along line 5B—5B with the cabinet carriage extended.

With continuing reference to the accompanying drawings wherein applied reference numerals indicate parts similarly identified in the following specification, the reference numeral 1 indicates generally the present device positioned alongside a bed 2 of the well known type having controls 3 and 4 for altering bed configuration to best suit patient needs. While the invention is described in conjunction with transfer of an invalid or hospital patient, it is to be understood that the lifting and transferring capabilities of the invention may be used otherwise as for example, in conjunction with the transporting of inanimate objects.

The device includes a base 5 wheel supported at 6 by caster wheels which are of the lockable type. With reference to FIG. 3, the base is underslung by means of wheel arches 7 with a spider-like frame 8 centrally supporting a cylindrical guide 10. Other bases may be equally suitable. Secured within the lower end of guide 10 is a cylinder support 11 for a hydraulic cylinder 12. Telescopically disposed about guide 10 is a cylinder 13 integral at its lower end with the central floor area 14 of a cabinet 9 which may include access doors 9A. The upper end of telescopic cylinder 13 is closed by a cap 13A to the underside of which is secured a star shaped member 15 to which is mounted the rod end 12A of hydraulic cylinder 12. Accordingly, hydraulic fluid, by valve means later described, to the lower end of cylinder 12 will cause upward travel of cabinet 9. A slip ring 16 on cylinder 13 is of suitable bearing material such as nylon.

Mounted on floor 14 of cabinet 9 by means of clevises as at 17 are the lower ends of a pair of swingable, telescopic arms 18 powered fore and aft by arm cylinders 20, typically shown in FIG. 3, and having piston rods 20A. Each telescopic arm includes a slide member 21 for imparting both extension and retraction movement to a later described carriage on cabinet 9. Accondingly, hydraulic pressure to the lower ends of cylinders 20 will cause the arms and their slide members to move in an arcuate path about their respective hinge pins at 22 with the slide members telescoping during travel of the arm through its arcuate path.

Figure 8:
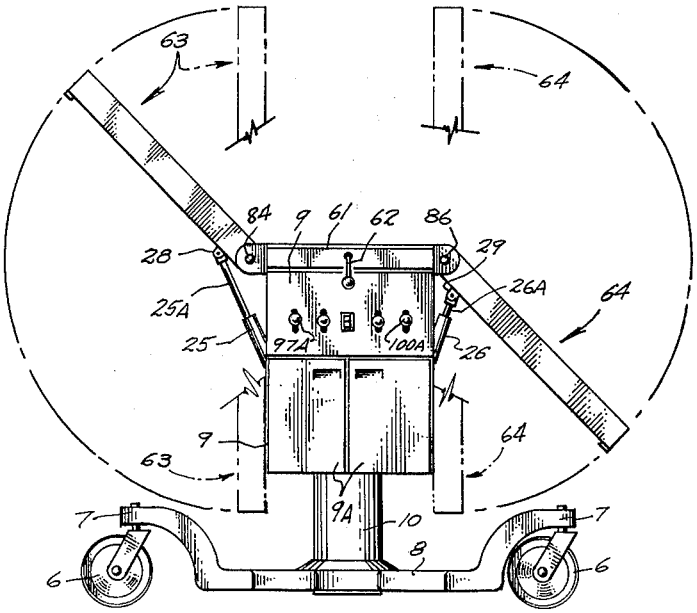
FIG. 8 is a frontal elevational view of the device with broken lines indicating the range of panel travel.

Indicated at 24 are cabinet sidewalls each defining a pair of openings 24A (FIG. 3) through which extend a pair of panel actuating cylinders 25 in pinned attachment as at 27 with sidewall mounted clevises 28. An identical pair of cylinders 26 extend through the opposite cabinet sidewall. With attention to FIG. 8, the piston rods 25A–26A of said cylinders are pivotally coupled to ears 28, 29 affixed to the underside of later described positionable panels. Also within cabinet 9 is a reservoir 30 in fluid circuit with a pump 31 driven by an electric motor 32 as later described in connection with the schematic.

With joint attention to FIGS. 5A and 5B along with FIG. 4, cabinet 9 includes a top wall 33 having lengthwise extending slots 33A formed therein adjacent the cabinet sidewalls. Disposed within slots 33A are the webs 34 interconnecting upper and lower carriage plates 35–36 of a cabinet carriage indicated generally at 37 which is slidably disposed on cabinet top wall 33. Depending from carriage plate 36 are ears 36A pivotally receiving arm slide members 21. Accordingly, forward motion imparted to arms 18 and particularly arm slide members 21 results in forward extension of carriage 37 along top wall 33 of the cabinet to the FIG. 5B position. Mounted on carriage plate 35 is second plate 38 which serves to mount bearings 39 within which is journalled a carriage shaft 40. Plate 38 is upturned at 38A and projects laterally for pivotal attachment to later described panel carriages.

To facilitate fore and aft motion of the carriage plates, the same may be surfaced with a synthetic friction reducing material (not shown). Main shaft 40, comprising part of the belt control means, is equipped with universal joints as at 41 (FIG. 4) offset laterally from the cabinet sides for coupling to similar shafts associated with each of the side panels as later described. Shaft 40 carries a power roll 42 for a patient contacting belt 43. A guard at G conceals power roll 42.

With attention again to carriage 37, the same additionally includes a belt supporting plate 44 of high density plywood, preferably of high density plywood to facilitate the taking of $x$-rays, said plate mounted at its inner end by a post 45 pivotally supporting at 46 a plate bracket 47. Accordingly, the uppermost run of belt 43 is supported for travel along plate 44 throughout all inclined positions of the belt (about hinge 46) during forward extension of the carriage 37 towards a hospital bed. At the forward end of carriage plate 44, a lead roller 48 (FIG. 4) is journalled within ears 49. Desirably the plate surface adjacent the lead roller is recessed to receive an insert of friction reducing material 51 extending transversely of the plate's forward end. To assure entrainment of the belt about lead roller 48 a first belt supporting roll 52 is rotatably mounted below the forward end of plate 44 by means of flanges at 50. A second belt supporting roll at 53 is cabinet mounted for rotation about a fixed spindle 54 and accordingly, supports belt 43 throughout fore and aft positioning of cabinet carriage 37. Additionally, roll 53 acts indirectly on the underside of plate 44 to support same and the patient's weight once the loaded carriage has been retracted away from bed contact.

Coaxially mounted (on cabinet carriage 37) with belt powering roll 42 on shaft 40 at opposite ends thereof, are shiftable cable reels 55 about which are wound several turns of flexible wire cable 56 all constituting a portion of belt control means for roll 42 and belt 43. Each of said cable reels has a companion cable reel 57 on spindle 54, as typically viewed in FIGS. 5A–5B, about which again are several turns of cable 56 with an upper run of cable at 56A extending intermediate the cable reels. A second or lower run of cable at 56B passes rearwardly from companion reel 57 to a cable control reel 58 typically shown in FIG. 4. The control reel 58 is rotatably supported on a fixed axis by a shaft 59 (having a flat sided segment) journalled within cabinet mounted bearings 60. Shaft 59 may be locked against rotation by means of a manually operated lock 62 located within a shaft and drum housing 61 and engageable with the flat sided segment of the shaft. Cable control reels 58 may accordingly be selectively locked by an operator against rotation during extension of the cabinet carriage. A cable cover plate 69 conceals the cables and cable reels 55 and 57 against contact with the patient or operator of the device.

With attention again to cable reels 55 (only one shown) rotatably mounted on cabinet carriage 37, rotation is imparted to the reel during forward travel of the carriage with reel rotation being counter-clockwise as viewed in FIG. 5A paying out a cable run 56C. Accordingly, as cable reel 55 rotates counter-clockwise a run of cable 56C is payed out as run 56A is taken up by reel 55 thus causing the upper surface of belt 43 to move (FIGS. 5A–5B) from right to left during forward displacement of carriage 37 toward a patient. Conversely, during rearward travel of carriage 37, belt 43 remains stationary with respect to belt supporting plate 44 by reason of cable control reels 58 (one shown) being unlocked by the operator to permit counter-clockwise rotation by tensioned cable runs 56B and 56A. Accordingly, belt travel over plate 44 occurs only during forward travel of carriage 37 and continues until such time as the carriage comes to rest at its forwardmost position as viewed in FIG. 5B. Extension of the carriage causes lead roll 48 and belt 43 passing therearound to exert a lifting action on the patient during advancement beneath the patient. Belt supporting roller 52, during patient pick up, traverses the horizontal surface of the bed with disparities between bed height and carriage height being compensated for by upward tilting movement of belt supporting plate 44 about hinge 46. At the forwardmost position of carriage 37, as viewed in FIG. 5B, lead roll 48 will be advanced entirely beneath the patient whereupon the patient is supported by cantilevered plate 44 which, in turn, is supported indirectly by cabinet mounted roll 53.

Indicated generally at 63 and 64 are side panels each independently adjustable relative to cabinet 9. Each panel incorporates identical powered belts at 65 and 66 as typically shown in FIG. 6. The following description, while pertaining to but one belt and its associated components, is equally pertinent to the belt and components of the remaining panel. Each panel assembly 63, 64 includes a tray-like structure having a bottom wall 67, a rear wall 68 and a sidewall 70. Bottom wall 67 defines lengthwise extending slots 67A (FIG. 4) within which is slidably mounted a panel carriage indicated generally at 71 much in the same manner as carriage 37 was mounted on cabinet 9. Upper and lower panel carriage plates at 72, 73 extend transversely across bottom wall 67 of the panel with a web 74 extending vertically between end portions said plates through slots 67A. In continuing similarity to the cabinet carriage said plates are desirably surfaced with a friction reducing synthetic material. Superimposed on carriage plate 72 is still another plate 75 upturned at its rearward end 75A and thereat supporting a carriage shield 76. The patient contacting belt 65 traverses a belt supporting plate 77 of high density plywood having a lead roller 78 fixed to its forward end while adjacent said end is an insert 80 of a synthetic material having friction reducing characteristics. Plate 77 additionally carries a belt supporting roll 81 confining the belt extremity for travel about lead roller 78. Said belt support roll is journalled at its ends within plate mounted flanges 79.

At the forward edge of panel bottom wall 67 is a second belt supporting roll 82 which roll has a stationary axis and is supported by brackets as at 83.

Each positionable panel 63, 64 is swingably mounted to the opposite sides of cabinet 9 for travel about horizontal axes embodied within pivotal connections 84 and 85 and 86 and 87 passing through cooperating, overlying brackets on cabinet 9 and the opposing bottom wall edges of each panel as shown in FIGS. 2 and 4. The aligned pivot means 84–85 and 86–87 of the two panels 63 and 64 permit inclined movement of said panels in response to extension or retraction of piston rods 25A, 26A with panel travel being through, as viewed in FIG. 8, approximately 180° with the extreme positions being for purposes of compact storage of the device.

For purposes of uniformly advancing each panel carriage 71, typically shown in FIG. 6, simultaneously with advancement of cabinet carriage 37, the panel carriages are provided with a pair of brackets 90 which project laterally for pinned engagement at 91 with a like pair of brackets 92 on each side of cabinet carriage 37. Accordingly, fore and aft movement of cabinet carriage 37 (resulting from like movement of telescopic arms 18) is transmitted via the brackets to panel carriages 71 thereby advancing belts 43, 65 and 66 toward a patient in a coordinated manner. Pivot pins 91 and pivot means 84–85 and 86–87 are coaxial. Patient pick up by the panel carried belts 65 and 66 is in a manner similar to that earlier set forth in connection with cabinet mounted belt 43 with the important aforementioned difference being that both belts 65 and 66 are operable throughout a range of transversely inclined positions to permit lifting of a patient from an irregular bed surface. As was the case with the cabinet belt 43, each panel belt 65, 66 may additionally be positioned about a hinge pin 93 coupling the lower side of plate 77 to carriage plate 75. As viewed in FIG. 1 the patient may remain in a medically optimum position during patient pick up and transfer to a discharge site.

With continuing attention to FIG. 6, powering each panel belt 65 and 66 is a carriage mounted power roll 94 on a shaft 95 journalled within bearings 96. Shaft 95 is coupled to and constitutes an extension of shaft 40 of the cabinet carriage via universal joints 41. Accordingly, upon forward travel of cabinet carriage 37, resultant rotation of cabinet roll 42 will be imparted to shafts 95 of each panel carriage during forward travel of same. The live belts 43, 65 and 66 will accordingly advance toward the patient by reason of the coupled carriages 37 and 71 with the belts thereon being synchronized both in belt speed and displacement. The earlier described bracket connection between the cabinet carriage and the laterally disposed panel carriages assures uniform advancement of the latter carriages with the cabinet carriage and conversely the return of the panel mounted carriages 71 with the cabinet carriage 37 to a retracted position. In continuing similarity to the operation of cabinet belt 43, panel belts 65 and 66 travel from right to left across their respective belt supporting plates 77. Lead roller 78 of each panel belt will travel beneath and exert a lifting action on respective portions of the patient's body in concert with lead roller 48 of the cabinet carriage. At their forward extremes of travel cabinet carriage 37 and panel carriages 71 and the belts associated therewith will have exerted a lifting action on the patient's body to cause same to ultimately be supported by carriage plate 44 and panel mounted plates 77 prior to the carriages reaching their forward limit of travel. The plates at such time will be supported in a cantilever manner by associated belt supported rollers 53 and 82 with carriage plates in upwardly biased contact with the underside of cabinet top wall 33 and the underside of panel top walls 67.

During retraction of the carriages by arms 18, the belt powering rolls will remain stationary by reason of the unlocked condition of cable control reel 58 which during carriage retraction rotates counter-clockwise in response to tensioned cable run 56B during carriage retraction as earlier described in connection with the operation of cabinet carriage 37.

Figure 7:
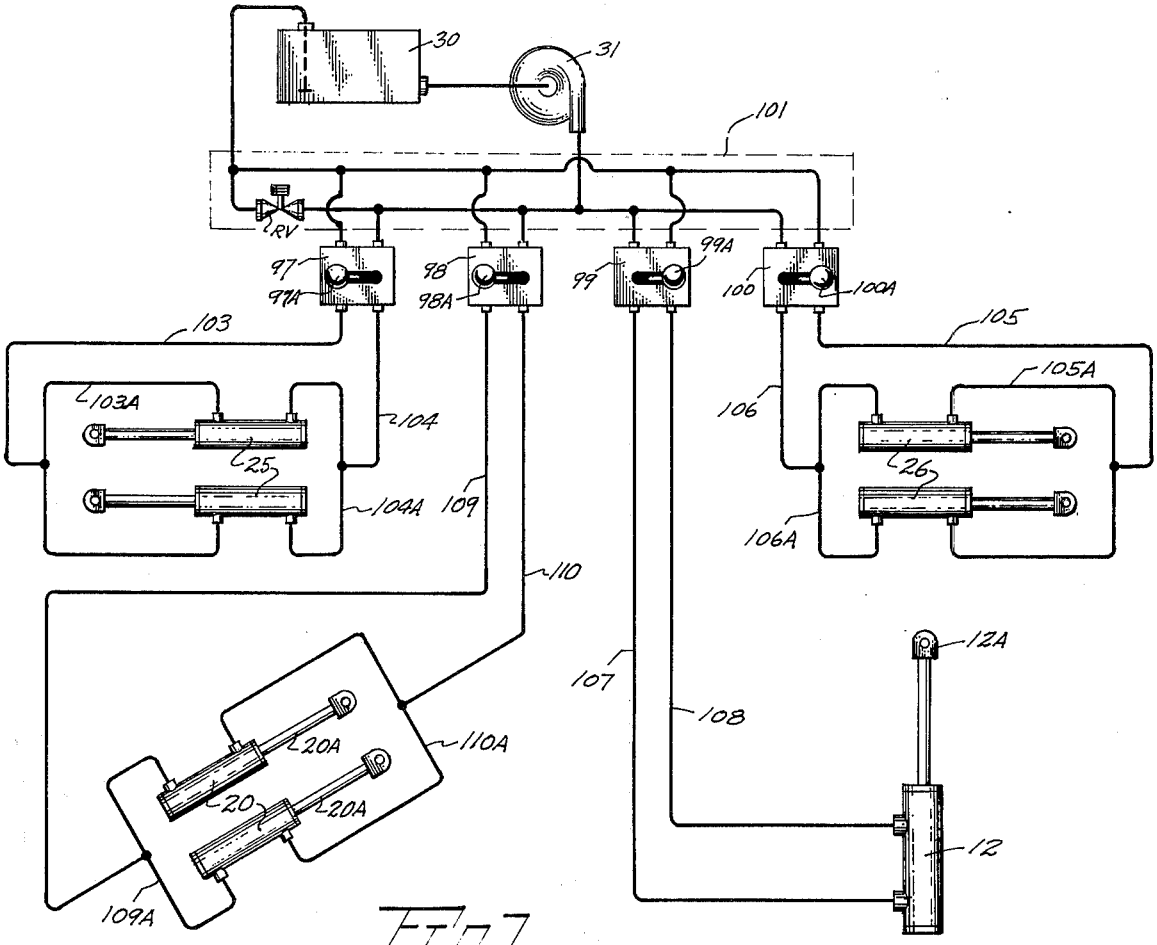
FIG. 7 is a hydraulic schematic.

With attention to the hydraulic schematic in FIG. 7, four hydraulic valves are indicated at 97, 98, 99, 100 each having a control 97A, 98A, 99A and 100A for actuation by an operator during a loading operation. A manifold 101 distributes pressurized fluid from pump 31 to each of said valves each of which preferably are of the three-position, four-way type with a centered control position closing the valve ports. Valve 97 controls flow to cylinders 25, associated with panel 63, via line 103 branched at 103A. Similarly, the base end of cylinders 25 is served by line 104 branched at 104A. Valve 100 selectively directs pressurized fluid through lines 105 and 106 branched at 105A and 106A to pressurize opposite ends of cylinders 26 associated with panel 64. Accordingly, the operator may independently position panel 63 and panel 64 about an axis extending through the earlier described pivot means coupling each panel to the side of cabinet 9. Valve 99 directs fluid alternately to the base or rod end of cabinet positioning cylinder 12 via lines 107 and 108 with the control 99A permitting a "locking" of the fluid circuit to cylinder 12.

In a patient loading operation subsequent to the adjustment of the panels and cabinet height, the belts 43, 65 and 66 are advanced simultaneously toward the patient by actuation of valve 98 which directs hyraulic pressure through conduit 109 and branch 109A pressurizing the base end of cylinders 20 with said cylinders being vented via a branched line 110A and line 110 to permit extension of piston rods 20A and the resultant forward arcuate travel of arms 18. The forward movement of cabinet carriage 37 and conjoint unreeling of cable runs 56A from drums 55 imparts right to left travel of cabinet belt 43 and simultaneously identical belt motion to panel belts 65 and 66.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A load-lifting and transporting device comprising in combination, a wheel-supported base, a cabinet adjustably carried by said base and positionable upwardly therefrom, roll means mounted on said cabinet adjacent one edge thereof, a carriage supported by said cabinet and forwardly extensible past said one edge of the cabinet into engagement with the object to be lifted, said carriage including a plate hingedly mounted at one of its ends to the carriage, a belt entraining roller at the distal end of said plate, a power roll, a load contacting belt entrained on the power roll and plate mounted roller and having top and bottom runs, the bottom run of said belt in supported contact with the cabinet mounted roll means during extension and retraction of the carriage, said plate also supported by said cabinet roll means, powered means concealed within said cabinet coupled with said carriage and imparting forward and rearward movement thereto, and belt control means including fixed axis, cable reels mounted adjacent opposite sides of said cabinet, a carriage-mounted cable reel in driving connection with said carriage power roll, said belt control means further including a continuous cable a lower run of which directly interconnects the cabinet-mounted cable reels, an upper run of the cable additionally entrained about said carriage mounted cable reel, operator controlled locking means for locking one of said cabinet-mounted reels against rotation whereupon forward extension of the carriage toward an object to be lifted will cause rotation of said carriage-mounted cable reel and said carriage power roll and hence movement to the load contacting belt in a direction opposite to the forward movement of the carriage, subsequent unlocking of the locking means prior to carriage retraction permitting the carriage mounted cable reel, power roll and belt with loaded object thereon to remain in a fixed relationship to the carriage during retraction of same.

2. The device as claimed in claim 1 wherein said carriage is slidably supported by a top wall of the walled cabinet, said powered means includes arms swingably mounted within the cabinet and attached at their distal ends to the underside of said carriage.

3. The device as claimed in claim 2 including hydraulic cylinders coupled to said arms at points intermediate the arm ends.

4. The device as claimed in claim 3 wherein said arms include telescopic end members attached to said carriage.

5. The device as claimed in claim 1 wherein said carriage includes a belt supporting roll subjacent the forward end of said hinged plate, said belt supporting roll additionally adapted to traverse a load supporting surface to partially support the hinged plate of the carriage during a load lifting operation.

6. The device claimed in claim 1 additionally including, a pair of panels laterally disposed on opposite sides of said cabinet, pivot means interconnecting each of said panels and the cabinet permitting movement of each panel about a horizontal axis, independently adjustable means coupled intermediate each of said panels and said cabinet for positioning of the panels through approximately 180° about their respective horizontal axes, a carriage slidably mounted on each panel and forwardly extensible beyond one panel side into engagement with the object to be lifted, each panel mounted carriage including a power roll and a plate hingedly mounted at one of its ends to the carriage, said plate having a belt entraining roller at its distal end, a load contacting belt carried by each of said panel mounted carriages and having top and bottom runs entrained on said power roll and the plate mounted roller, and bracket means pivotally interconnecting the cabinet supported carriage with each panel mounted carriage at points along said horizontal axes enabling the imparting of forward and rearward movement to the panel mounted carriages by said cabinet supported carriage while permitting panel adjustment about their respective axes by said adjustable means.

7. A load lifting and transporting device imparting lifting and lateral motion to an object to be transported, said device comprising, a wheel supported base, a cabinet adjustably supported on said base and including powered means, a pair of panels hingedly mounted to and projecting laterally from opposite sides of the cabinet, each panel adapted for hinged movement about a horizontal axis, adjustable means extending intermediate the cabinet and each panel for hingedly positioning each panel independently about its horizontal axis, cabinet mounted carriage means slidably supported by the top wall of said cabinet and positioned thereon by said powered means, panel carriage means slidably supported by each of said panels, means interconnecting the cabinet and panel carriage means for transmission of fore and aft movement to the panel carriage means, each of said cabinet and panel carriage means including, a belt having an upper run for contact with the object being lifted, a hinged plate underlying and supporting said upper belt run including a lead roller, a belt powering roll, means coupling each of said power rolls to one another in a universal manner, belt control means on said cabinet including, fixed axis reels mounted on opposite sides of the cabinet, cable means entrained about and extending intermediate said reels, a shiftable reel on the cabinet carriage means in driving connection with the power roll on the cabinet carriage, said cable means also entrained about said shiftable reel, reel locking means on said cabinet for locking one of the cabinet mounted reels against rotation whereupon forward extension of the cabinet carriage will impart rotation to the shiftable reel and belt power roll of the cabinet carriage to cause the upper run of the carriage belts to move simultaneously in a direction opposite to the forward movement of carriage travel during load engaging extension of the carriages, and unlocking of said one cabinet mounted reel prior to retraction of the carriage permitting the shiftable carriage supported reel to remian inoperable during carriage retraction permitting the belt on each carriage to remain fixed on its respective carriage during retraction.

8. The device as claimed in claim 7 wherein said shiftable reel of the belt control means is rotated during forward extension of the cabinet carriage by said cable means extending intermediate the shiftable reel and a lockable fixed axis cabinet reel, said shiftable reel simultaneously during forward extension of the cabinet carriage retrieving cable means extending intermediate the shiftable reel and remaining fixed axis reel on the cabinet.

9. The device as claimed in claim 7 wherein said powered means include arms swingably mounted within the cabinet and attached at their distal ends to the underside of said cabinet carriage means.

10. The device as claimed in claim 9 including hydraulic cylinders coupled to said arms at points intermediate the arm ends.

11. The device as claimed in claim 10 wherein said arms include telescopic end members attached to the cabinet carriage.

12. The device as claimed in claim 7 wherein each of said carriage means additionally includes a belt supporting roll subjacent one end of of the hinged plate adapted for traversing a load supporting surface to partially support their respective carriages therein during a load lifting operation.

* * * * *